United States Patent [19]

Weisbrod

[11] Patent Number: 4,916,945

[45] Date of Patent: Apr. 17, 1990

[54] APPARATUS AND METHOD FOR TRANSFERRING WHOLE CORE SAMPLES

[75] Inventor: Kirk R. Weisbrod, Celina, Tex.

[73] Assignee: Atlantic Richfield Company, Los Angeles, Calif.

[21] Appl. No.: 308,487

[22] Filed: Feb. 10, 1989

[51] Int. Cl.[4] ..... E21B 49/00

[52] U.S. Cl. ..... 73/153

[58] Field of Search ..... 73/153, 863, 864.91; 53/442

[56] References Cited

U.S. PATENT DOCUMENTS 4,071,099 1/1978 Hensel, Jr. ..... 73/864.91

4,587,857 5/1986 Bush ..... 73/863

*Primary Examiner*—Hezron E. Williams

*Assistant Examiner*—Kevin D. O'Shea

*Attorney, Agent, or Firm*—F. Lindsey Scott

[57] ABSTRACT

An apparatus for transferring a whole core sample having a first end and an opposing second end from the interior of an inner barrel comprising:

a split receiving tube having an interior surface sized and adapted to receive the whole core sample from the inner barrel;

a liner made of heat shrink material extending over a substantial portion of the interior surface of the split receiving tube;

first and second discs sized and adapted to be placed on the first and second ends, respectively, of the whole core sample; and a force assembly for forcing the whole core sample from the inner barrel into the liner in the split receiving tube.

23 Claims, 1 Drawing Sheet

APPARATUS AND METHOD FOR TRANSFERRING WHOLE CORE SAMPLES

BACKGROUND OF THE INVENTION

This invention relates to transferring whole core samples, e.g., for handling and transport. More particularly, the present invention relates to apparatus and methods for transferring whole core samples which promote the preservation of the samples in the "as obtained" state.

Core samples obtained from subterranean formations are often used to assist in determining the commercial potential, e.g., commercial petroleum producing potential, of such formations. Since detailed analysis of these core samples frequently occurs away from the sampling site, it is necessary to transport the samples for analysis. The most useful analysis of such cores are obtained if the samples are maintained in the "as obtained" state or condition. A number of methods have been used to preserve such core samples in the "as obtained" condition.

Unconsolidated and other friable core samples are generally frozen to reduce grain rearrangement during handling and transportation. However, freezing may alter the rock sample. When freezing is suspected of altering the rock sample, another method of preservation is used. Most of these other methods involve encapsulation of the core in wax or epoxy resin. The potential for imbibition of such materials into the sample is of concern. In addition, if further shrinkage of the sample should occur, e.g., during transportation, the rigid walls of the solidified encapsulating material provides limited, if any, support for the rock sample so that the sample may fall apart. A new system overcoming these concerns and problems would clearly be advantageous.

The technical literature has described the confinement of plugs with heat shrink tubing. However, such tubing is not believed to have been used on whole core samples during confinement.

SUMMARY OF THE INVENTION

A new system for transferring a whole core, e.g., for transport, has been discovered. This system involves the use of heat shrink material and eliminates many, if not all, of the concerns and problems caused by freezing the core and by encapsulating the core in wax or epoxy resin. Thus, the rock sample is left substantially unaffected, e.g., unaltered, by the present system. The potential for imbibition of encapsulating materials is greatly reduced, if not eliminated.

The present system with heat shrink material coating a substantial portion of the surface of the whole core sample provides continued, positive confinement to the rock sample. Thus, if the sample should shrink, the heat shrink material will also shrink and continue to exert a positive force acting to maintain the structure or configuration of the confined sample. If desired, plugs can easily be obtained through the heat shrink material coating, e.g., by removing a section of the coating with a knife e.g., a cutting tool sold under the trademark "Exacto", and taking a plug with a punch.

In one broad aspect, the present invention is directed to a whole core sample having an exterior lateral surface which is covered with heat shrink material. This whole core sample is preferably transferred substantially directly from the interior of an inner barrel in which it is originally recovered or collected into the heat shrink material for confinement.

Another broad aspect of the invention involves an apparatus for transferring a whole core sample, having first and opposing second ends, from the interior of an inner barrel. This apparatus comprises a split receiving tube, a liner or tube made of heat shrink material, first and second discs and a means, e.g., a piston. The split receiving tube is hollow, has an interior surface, and is adapted and sized to receive the whole core sample from the inner barrel. The liner extends over a substantial portion, preferably over substantially all, of the interior surface of the split receiving tube. The first and second discs are sized and adapted to be placed in contact with, e.g., on, the first and second ends of the whole core sample. The means, e.g., a manually powered piston, acts to force the whole core sample from the inner barrel into the liner in the split receiving tube. A heating means, e.g., a heating gun, is preferably included for providing heat to shrink the liner around the whole core sample, preferably around the whole core sample and the first and second discs.

This apparatus can be used in a method for transferring a whole core sample from the interior of an inner barrel. This method comprises placing a split receiving tube with a liner over its interior surface, e.g.,as described above, in close proximity to the inner barrel so that the longitudinal axes of the split receiving tube and inner barrel substantially align. First and second discs are placed on the first and second ends, respectively, of the whole core sample. A force is applied to the whole core to move the whole core from the inner barrel into the liner in the split receiving tube. A portion, preferably one half, of the split receiving tube is removed, which leaves the whole core sample in the liner cradled in the other portion, preferably the other half, of the split receiving tube. The liner is heated to shrink the liner around the whole core sample, preferably around the whole core sample and the first and second discs. At this point, the heat shrink material coated whole core sample is ready to be removed from the remaining portion of the split receiving tube, and transported or used, as desired.

The present system is useful to transfer and confine any whole core sample obtained from a subterranean formation. Such samples, as obtained, are located in the inner barrel of the core sampling assembly. The present invention is particularly applicable with unconsolidated or other friable core samples which are relatively fragile and subject to grain rearrangement, rock alteration and/or shrinkage during transportation and handling.

Any suitable heat shrink material may be employed in the present invention. A number of suitable heat shrink materials are conventional and well known in the art. As used herein, the term "heat shrink material" refers to a material coating an object which when heated to a given temperature exerts a positive force on the object. Thus, upon heating to a given temperature, the heat shrink material coating "squeezes" the object. This "squeezing" force is continually exerted, even after the temperature of the material falls below the given temperature. One important class of heat shrink materials are those which exhibit "size memory". Such materials are activated by being heated to a given temperature to revert to their original size. Thus, for example, a material which exhibits size memory can be made into the form of a relatively small diameter hollow tube. This hollow tube is expanded, e.g., using gas pressurization or another technique, to a larger diameter. While expanded, a whole core sample and first and second discs, as described herein, are placed in the hollow tube, which is then heated to activate its "memory". The expanded hollow tube seeks to return to its original, relatively small size, and in so doing contracts around the whole core sample and first and second discs, and confines the sample with a positive force which continues even after the hollow tube cools below its "memory activating" temperature.

The heat shrink material or materials employed are preferably polymeric materials. These polymeric materials may be thermoplastics. A number of polymeric materials are known to have heat shrink properties. Examples of such materials include polytetrafluoroethylene, fluorinated ethylene/propylene copolymers, polytetrafluoroethylene with perfluoroalkoxy side chains, polyvinylidene fluoride and the like. Such materials, especially fluorinated ethylene/propylene copolymers, have desirably low friction qualities or properties which facilitate the movement of the whole core sample from the inner barrel.

The heat shrink coating on the whole core sample and the first and second discs are preferably transparent to aid in the inspection of the whole rock sample.

The first and second discs are adapted to be placed in contact with the corresponding ends of the whole core sample. Preferably, the discs are sized to substantially conform to the ends of the sample on which they are placed.

The first and second discs may be made of a suitable material or materials. The discs are preferably substantially rigid at the conditions of use. Both first and second discs are preferably made of the same material. Examples of materials from which the discs can be made include metals, e.g. aluminum and the like, and polymeric materials, e.g. polycarbonates, polymethylmethacrylate and the like.

As noted above, the means acts to force the whole core sample from the inner barrel into the liner in the split receiving tube. In one embodiment, such means includes a first piston located so as to contact the first disc, which is in contact with the first end of the whole core sample. A primary force is applied, e.g. manually and/or by mechanical (e.g., hydraulic) means, to the first piston to force or urge the whole core sample out of the inner barrel and into the liner in the split receiving tube. Preferably, the means further includes a second piston located so as to contact the second disc, which is in contact with the second end of the whole core sample. A resisting force is applied, e.g., manually and /or by mechanical (e.g. hydraulic) means, to the second piston to resist the primary force, i.e., to resist the movement of the whole core sample from the inner barrel into the liner in the split receiving tube. The primary force is greater than the resisting force so that there is net movement of the whole core sample from the inner barrel to the liner in the split receiving tube. This resisting force is useful in maintaining the configuration or structure of the whole core as it is moved from the inner barrel to the liner.

These and other aspects and advantages of the present invention are set forth in the following detailed description and claims, particularly when considered in conjunction with the accompanying drawings in which like parts bear like reference numerals.

DETAILED DESCRIPTION OF THE DRAWINGS

Figure 1:
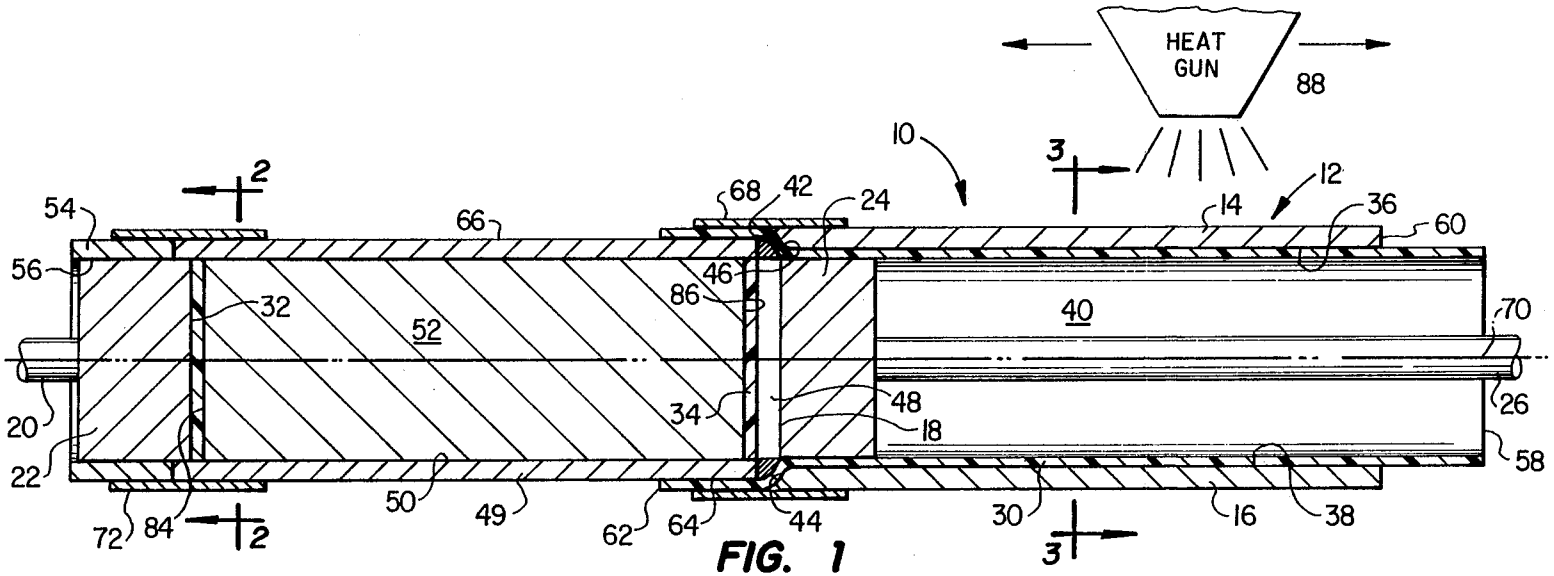
FIG. 1 is a side view, in cross-section, showing one embodiment of the present apparatus.
Figure 3:
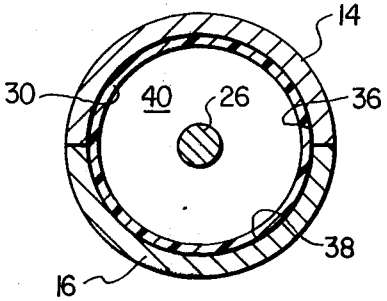
FIG. 3 is a cross-sectional view taken along line 3—3 of FIG. 1.

Referring now to the drawings, a whole core sample transfer system, shown generally at 10, includes a split receiving tube 12 having first and second tube portions 14 and 16, a conical section 18, a first shaft 20, a first piston 22, a second piston 24 and a second shaft 26. System 10 also includes a heat shrink sleeve 30, a first disc 32 and a second disc 34.

First tube portion 14 includes a first inner wall 36 while second tube portion 16 includes a second inner wall 38. Each of the first and second inner walls 36 and 38 have a semi-circular cylindrical configuration. Thus, when first and second tube portions 14 and 16 are fitted together to form receiving tube 12, first and second inner walls 36 and 38 together define an open ended, right circular cylindrical space 40.

The rearwardly extending end walls 42 and 44 of first and second tube portions 14 and 16, respectively, are slanted in a concave manner as shown in FIG. 1. Such slanting is configured to complement the conical slanting of the outer peripheral wall 46 of conical section 18.

Conical section 18 is hollow and defines an open ended interior space 48, which has substantially the same cross-section as space 40.

An inner barrel 49 is hollow and includes an interior wall 50 which defines a right circular cylindrically shaped, open ended inner space. A whole core sample 52 is located in the inner space defined by interior wall 50 of inner barrel 49. Sample 52 is from a subterranean formation and is obtained in inner barrel 49 by conventional core sampling techniques.

Tube section 54 is hollow and has an inside wall 56 which defines an inside space having substantially the same cross-section as the inner space defined by interior wall 50.

Heat shrink sleeve 30, made out of heat shrink fluorinated ethylene/propylene copolymer, is brought into contact with first and second inner walls 36 and 38. In this manner, sleeve 30 is positioned as a liner with respect to the inner walls 36 and 38 of split receiving tube 12. The space defined by heat shrink sleeve 30 in contact with first and second inner walls 36 and 38 has a slightly larger crosssectional area than that of sample 52. For example, this space may have a diameter a fraction of an inch larger than the diameter of sample 52. This size difference reduces undesirable frictional contact between sample 52 and heat shrink sleeve 30 during the transfer of sample 52 from inner barrel 49. The forward open end 58 of sleeve 30 extends forwardly beyond the forward end 60 of the split receiving tube 12. The rear open end 62 of sleeve 30 extends rearwardly beyond the rearwardly extending end walls 42 and 44 of first and second tube portions 14 and 16, respectively, of split receiving tube 12. The rear end portion 64 of sleeve 30 is positioned to be between end walls 42, 44 and outer peripheral wall 46 of conical section 18, and to be in contact with the outer wall 66 of inner barrel 49, as shown in FIG. 1. The tapering of outer peripheral wall 46 in combination with end walls 42 and 44 provides a smooth transition for the enlargement in diameter of heat shrink sleeve 30 as it extends from inside split receiving tube 12 to the outer wall 66 of inner barrel 49.

A first flexible clamp 68 is secured around the forward end of inner barrel 49, the conical section 18 and the rear end of split receiving tube 12. First flexible clamp 68 acts to maintain alignment of space 40, interior space 48 and the inner space defined by exterior wall 50 along a common axis 70. First flexible clamp 68 also acts to hold the rear end portion 64 of sleeve 30 around and in contact with the outer wall 66 of inner barrel 49, as shown in FIG. 1. A second flexible clamp 72 is secured around the rear end of inner barrel 49 and the forward portion of tube section 54 and acts to align the inner space defined by inside wall 56 and the inner space defined by interior wall 50 of inner barrel 49 along the axis 70.

Figure 2:
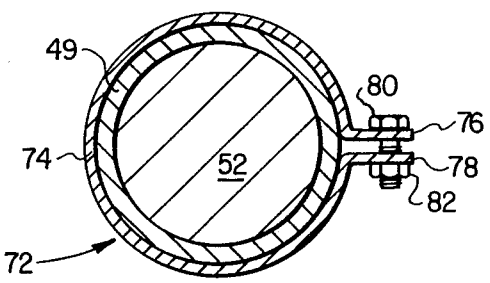
FIG. 2 is a cross-sectional view taken along line 2—2 of FIG. 1.

First and second flexible clamps 68 and 72 are structured identically. Such structure is best shown in FIG. 2, with reference to second flexible clamp 72. Thus, second flexible clamp 72 includes a clamp body 74 and first and second clamp extensions 76 and 78. A bolt 80 is passed through holes in first and second clamp extensions 76 and 78 and secured to a nut 82. This nut/bolt combination acts to secure second clamp 72 around inner barrel 49 and tube section 54, as shown in FIG. 1. First and second flexible clamps 68 and 72 are made of a material or materials which are sufficiently flexible to allow the clamps to be positioned, e.g. slipped into place, prior to be secured, as noted above. First and second flexible clamps 68 and 72 can be made of metal, polymeric material and the like.

The first and second discs 32 and 34, preferably made of a transparent polymeric material, such as polycarbonates, polymethylmethacrylate and the like, are placed in contact with first and second ends 84 and 86, respectively, of whole core sample 52. First and second discs 32 and 34 are sized to cover substantially the entire first and second ends 84 and 86, respectively, of whole core sample 52.

The first and second pistons 22 and 24 are brought into contact with first and second discs 32 and 34, respectively. First and second pistons 22 and 24 are preferably made of lightweight, yet strong, material or materials to facilitate the operation of core transfer system 10. For example, the pistons can be made of wood, aluminum and the like. First and second pistons 22 and 24 are sized and structured to apply substantially the same force at all points on the first and second discs 32 and 34, respectively. Preferably, the cross-section of first and second pistons 22 and 24 perpendicular to axis 70 are substantially the same as the cross-section of first and second discs 32 and 34, respectively, perpendicular to axis 70.

First and second pistons 22 and 24 are secured to first and second shafts 20 and 26, respectively. First and second shafts 20 and 26 act to facilitate the application of a given amount of force to first and second pistons 22 and 24, respectively. For example, if the forces are to be applied manually, the first and second shafts 20 and 26 can be manually grasped and urged inwardly toward whole core sample 52. Alternately, if the forces are to be applied using mechanical, e.g., hydraulic means, the first and second shafts 20 and 26 can be secured to such mechanical means (not shown) and urged inwardly toward whole core sample 52. A combination of manual and mechanical forces may be used to operate the shafts and pistons.

With whole core sample transfer system 10 arranged as discussed above and as shown in FIG. 1, a primary force is applied to first piston 22 through first shaft 20, and a resisting force is applied to second piston 24 through second shaft 26. The primary force acts to urge first disc 32, whole core sample 52 and second disc 38 to move into sleeve 30 in split receiving tube 12, whereas the resisting force acts to resist such movement. The primary force is larger than, and overcomes, the resisting force so that such movement does occur, and whole core sample 52 and first and second discs 32 and 34 are transferred into sleeve 30 in split receiving tube 12. However, the resisting force is sufficient to maintain the structural integrity of whole core sample 52 as it is being moved.

Once whole core sample 52 and first and second discs 32 and 34 are in sleeve 30 in split receiving tube 12, first flexible clamp 68 is released and split receiving tube 12 is separated from inner barrel 49 and conical section 18. The first tube portion 14 of split receiving tube 12 is then separated from the second tube portion 16. This leaves whole core sample 52, first and second discs 32 and 34 and sleeve 30 cradled in second tube portion 16.

Heat from heat gun 88 is then applied to sleeve 30 in the areas surrounding first and second discs 32 and 34. This heat is sufficient to shrink sleeve 30 around first and second discs 32 and 34 at first and second ends 84 and 86, respectively, of whole core sample 52. Heat from heat gun 88 is then applied along the length of whole core sample 52 to shrink sleeve 30 along the length of whole core sample 52 as uniformly as possible. After shrinking, sleeve 30 should extend about 1 to about 2 inches beyond the ends of first and second discs 32 and 34. Excess material from sleeve 30 can be trimmed, if necessary. The confined whole core sample 52 is then removed from the second tube portion 16 and is ready for use and/or shipment, as desired. Sleeve 30 exerts a continuing positive force on whole core sample 52 and first and second discs 32 and 34 so that the structural integrity of whole core sample is maintained even in the event that whole core sample 52 shrinks, e.g., during shipment or storage.

While this invention has been described with respect to various specific examples and embodiments, it is to be understood that the invention is not limited thereto and that it can be variously practiced within the scope of the following claims.

What is claimed is:

1. An apparatus for transferring a whole core sample having a first end and an opposing second end from the interior of an inner barrel comprising:

a split receiving tube having an interior surface sized and adapted to receive the whole core sample from the inner barrel;

a liner made of heat shrink material extending over a substantial portion of the interior surface of said split receiving tube;

first and second discs sized and adapted to be placed in contact with the first and second ends, respectively, of the whole core sample; and means for forcing the whole core sample from the inner barrel into said liner in said split receiving tube.

2. The apparatus of claim 1 which further comprises heating means for providing heat to shrink said liner around the whole core sample.

3. The apparatus of claim 1 which further comprises heating means for providing heat to shrink said liner around the whole core sample and the first and second discs.

4. The apparatus of claim 1 wherein said means includes a first piston located so as to contact said first disc and to which a primary force is applied to move the whole core sample out of the inner barrel.

5. The apparatus of claim 4 wherein said means further includes a second piston located so as to contact said second disc and to which a resisting force is applied to resist the movement of the whole core sample from the inner barrel.

6. The apparatus of claim 1 wherein the inner barrel has an exterior surface and said liner is sized and adapted to extend out from said split receiving tube over at least a portion of the exterior surface of the inner barrel.

7. The apparatus of claim 6 which further comprises a tube section having a conically shaped outer peripheral wall located between the inner barrel and said split receiving tube.

8. The apparatus of claim 1 which further comprises alignment means to align said split receiving tube with the inner barrel.

9. The apparatus of claim 1 wherein said heat shrink material is a polymeric material.

10. The apparatus of claim 1 wherein said heat shrink material is selected from the group consisting of polytetrafluoroethylene, fluorinated ethylene/propylene copolymers, polytetrafluoroethylene with perfluoroalkoxy side chains, polyvinylidene fluoride and mixtures thereof.

11. The apparatus of claim 1 wherein said material is selected from the group consisting of fluorinated ethylene/propylene copolymers and mixtures thereof.

12. The apparatus of claim 1 wherein each of said first and second discs is made of a material selected from the group consisting of metals and polymeric materials.

13. The apparatus of claim 8 wherein said alignment means includes one or more split clamp tubes fitted onto the inner barrel and said split receiving tube.

14. The apparatus of claim 8 wherein said inner barrel has an exterior surface, said liner extends out from said split receiving tube over at least a portion of the exterior surface of the inner barrel and said alignment means further acts to restrain said liner from movement while the whole core sample is being moved from the inner barrel to said split receiving tube.

15. The apparatus of claim 14 wherein said alignment means includes one or more clamps fitted onto the inner barrel and said split receiving tube.

16. A method for transferring a whole core sample having a first end and an opposing second end from the interior of an inner barrel comprising:

placing a split receiving tube having an interior surface sized and adapted to receive the whole core sample from the inner barrel in close proximity to the inner barrel so that the longitudinal axes of said split receiving tube and the inner barrel substantially align, said split receiving tube having a liner made of heat shrink material over a substantial portion of said interior surface;

placing first and second discs in contact with the first and second ends, respectively, of the whole core sample;

applying a force to the whole core sample to move the whole core sample from the inner barrel into said liner in said split receiving tube;

removing a portion of said split receiving tube; and heating said liner to shrink said liner around said whole core sample.

17. The method of claim 16 which further comprises heating said liner to shrink said liner around said first and second discs.

18. The method of claim 16 which further comprises applying a resisting force to the whole core sample to resist the movement of the whole core sample from the inner barrel to said liner in said split receiving tube as said whole core is being moved from the inner barrel to said liner in said split receiving tube.

19. The method of claim 16 wherein the inner barrel has an exterior surface and said liner is sized and adapted to extend out from said split receiving tube over at least a portion of the exterior surface of the inner barrel.

20. The method of claim 16 wherein said heat shrink material is a polymeric material.

21. The method of claim 16 wherein said heat shrink material is selected from the group consisting of polytetrafluoroethylene, fluorinated ethylene/propylene copolymers, polytetrafluoroethylene with perfluoroalkoxy side chains, polyvinylidene fluoride and mixtures thereof.

22. The method of claim 16 wherein said heat shrink material is selected from the group consisting of fluorinated ethylene/propylene copolymers and mixtures thereof.

23. The method of claim 16 wherein each of said first and second discs is made of a material selected from the group consisting of metals and polymeric materials.

* * * * *